United States Patent [19]

Bühler

[11] Patent Number: 4,476,564

[45] Date of Patent: Oct. 9, 1984

[54] GAS EXHAUST NOZZLE FOR ARC FURNACES

[75] Inventor: Karl Bühler, Nussbaumen, Switzerland

[73] Assignee: BBC Brown, Boveri & Company, Limited, Baden, Switzerland

[21] Appl. No.: 410,581

[22] Filed: Aug. 23, 1982

[30] Foreign Application Priority Data

Sep. 1, 1981 [CH] Switzerland ..... 5615/81

[51] Int. Cl.[3] ..... F27D 3/10

[52] U.S. Cl. ..... 373/9; 373/81

[58] Field of Search ..... 373/8, 9, 73, 81, 79

[56] References Cited

U.S. PATENT DOCUMENTS 3,173,980 3/1965 Hysinger ..... 373/9 X 3,428,301 2/1969 Chermely ..... 373/73 X

*Primary Examiner*—Roy N. Envall, Jr.

*Attorney, Agent, or Firm*—Oblon, Fisher, Spivak, McClelland & Maier

[57] ABSTRACT

Arc furnace has a furnace shell, a furnace lid with lid ring and a lid lifting and swivelling means as well as a lid opening in the furnace lid for exhausting the flue gas from the interior of the furnace and a flue gas exhaust nozzle for removing the flue gases above the lid opening, the nozzle being supported on the furnace lid ring. By means of this design feature as well as a guide arrangement and a locking means the flue gas exhaust nozzle can be completely integrated into the operating steps of the arc furnace in a simple and economical fashion.

5 Claims, 6 Drawing Figures

GAS EXHAUST NOZZLE FOR ARC FURNACES

BACKGROUND OF THE INVENTION

1. Field of the Invention

The invention concerns an arc furnace with a furnace shell, a furnace lid with lid ring and a lid lifting and swivelling means. The furnace lid has a lid opening for exhausting the flue gases from the interior of the furnace, and a flue gas exhaust nozzle arranged above the lid opening for removing the flue gases.

2. Description of the Prior Art

The design of the flue gas exhaust nozzle and especially its arrangement with respect to the arc furnace is of particular importance, because it is on the one hand the connecting link in the exhaust removal system between the movable furnace vessel and the fixed exhaust line and on the other hand must be completely integrated into the individual operating steps of the furnace operation.

The following are the main operating steps in the operation of the arc furnace:

1. Charging. For this purpose, the furnace lid normally raised from the furnace vessel, is swivelled out of range of the furnace vessel and then, after charging of the furnace is completed, is again brought back to its initial position and lowered onto the furnace vessel.

2. Smelting. The hot and dust-laden waste gases are exhausted by direct exhaustion out of the furnace vessel via a fourth lid opening.

3. Pouring. The furnace is successively tilted until it has been completely emptied.

4. Swivelling the lid. By means of a lid raising and swivelling means, i.e., the so-called superstructure, the furnace lid is first raised vertically upwards from the furnace vessel and is then swivelled horizontally to the side.

In the direct exhaust systems on arc furnaces known at the present time the exhaust nozzle is attached to the superstructure. The lower end of the nozzle is situated above the lid opening at a distance somewhat greater than that through which the lid is raised. The free space between furnace lid and exhaust nozzle is closed by means of a cylindrical connection piece, the so-called collar, into the upper part of which the bottom end of the exhaust nozzle protrudes in a telescopic fashion and the bottom end of the collar is supported on the furnace lid above the lid opening. The collar consists of heat resistant steel sheet and its weight is negligible. Since the lower part of the collar is exposed to high thermal stress, it is normally water cooled in order to avoid oxidation and distortion. This, however, requires an additional cooling circuit with monitoring and control arrangements. When the lid is lifted the collar is either lifted by means of an additional lifting arrangement or it is lifted together with the furnace lid, since it rests on it in a freely movable fashion.

The exhaust nozzle, and thus also the collar, are arranged vertically with respect to the curved surface of the lid and normally form an included angle of 18° to 20° with the lid axis. If there is no additional lifting arrangement provided then, when the lid is lifted, the direction of lift of the lid and the direction of shift of the collar differ by the amount of this angle and lateral forces arise which are transmitted to the lid arch.

The surface of contact of the lid and the collar can be maintained relatively gas-tight, but this is no longer the case, for design reasons, where the upper part of the collar overlaps with the lower part of the nozzle. As a result there is uncontrolled gas escape at the transition from collar to nozzle.

The above explanations make it clear that, with the presently known direct exhaust systems on arc furnaces, the collar necessitates additional arrangements for lifting the furnace lid and also detracts from the efficiency of the flue gas exhaustion.

SUMMARY OF THE INVENTION

The invention aims at remedying the above problems. The invention achieves the object of producing an arc furnace with direct exhaust of the waste gases by means of a flue gas exhaust nozzle, which causes the waste gases to be optimally drawn off and which can be integrated into the operating steps of the arc furnace in a simple and economically fashion by the nozzle being supported on the furnace lid ring.

The invention achieves essentially the following advantages.

1. The furnace lid and the flue gas nozzle can be replaced simply and at the same, simply by using the lid raising and swivelling means.

2. The flue gas nozzle can be lifted away from the lid to be replaced before the lid change, for instance by means of the steel plant crane and, after the lid has been replaced is placed again onto the new lid in the position envisaged for it in the design. This solution represents the normal case, since the furnace lid is subjected to a higher rate of wear than the nozzle and has thus to be replaced more frequently.

3. The furnace lid and the flue gas nozzle can be transported to the lid exchange location together with the lid lifting and swivelling means and the original nozzle can there be lifted away from the lid to be exchanged, for instance by means of the steel plant crane, and is positioned on the new lid in the position provided for it. Then the new lid together with the original nozzle are swivelled back into the starting position and are placed onto the furnace vessel.

4. There are no complicated devices and control arrangements for liquid cooling of the collar.

The objection that it is less troublesome to lift a relatively light collar than a flue gas nozzle weighing something like a ton becomes unimportant when it is considered that the weight of the nozzle is only a fraction of the weight of the whole lid and that therefore the lid lifting arrangement is not subjected to an appreciably higher load.

The nozzle is supported non-positively or positively on the lid ring, so that it remains immovably fixed on the lid ring when the furnace is tilted or the lid is swivelled.

In an advantageous further development of the object of the invention, the nozzle is provided with a guide arrangement, which acts together with the lid lifting and swivelling means in such a way that the nozzle is guided when the lid is lifted and is supported when the furnace is tilted. With such a design feature a non-positive or positive support of the nozzle on the lid ring in the direction of tilt, when the furnace is poured or emptied, becomes unnecessary.

The guide arrangement of one embodiment includes, on the one hand, at least one guide rail running in the direction of lift of the furnace lid and on the other and at least a pair of guide rollers.

The guide rail runs between two guide rollers.

The guide rail is firmly attached to the support arm of the lid lifting arrangement and the guide rollers are firmly attached to the nozzle.

The guide rail can instead be firmly attached to the nozzle and the guide rollers firmly attached to the support arm of the lid lifting arrangement. The advantageous effect of this feature is apparent from the relative simplicity of design needed to achieve a secure guiding of the nozzle during the lifting and lowering movement.

The guide arrangement of a further embodiment contains at least a pair of guide levers, which are flexibly connected with first ends acting in the same direction as the support arm of the lid lifting arrangement and with the other ends flexibly connected with the nozzle; the support of the nozzle on the lid ring takes place by means of at least one further lever.

The guide levers are equally long and arranged in parallel. The guide arrangement has the advantage that the guide rollers can be dispensed with.

The guide arrangement includes a locking means to secure the nozzle in a raised position. This enables the lid to be separated from the nozzle, since the nozzle, after the locking process, remains guided and locked in the lid lifting and swivelling means and the necessary operating steps, for example lid replacement or repairs on the lid, can be carried out on the lid independently of the nozzle.

The guide arrangement and/or the locking arrangement are positioned symmetrically on both sides of the nozzle. This has the advantage that the positive or non-positive support of the nozzle on the lid ring can be completely dispensed with, since the nozzle is guided in both tilting directions of the furnace.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENTS

Figure 1:
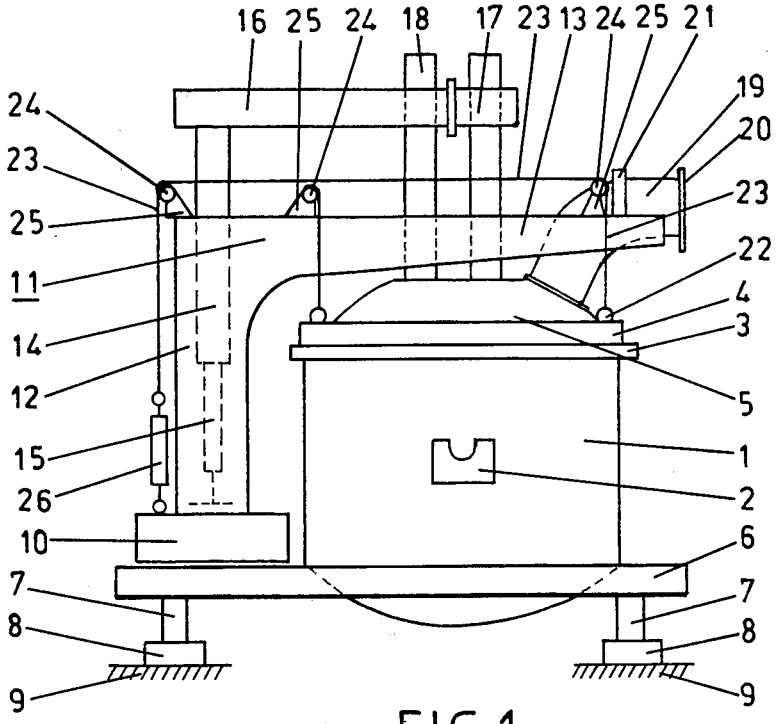
FIG. 1 is a schematic view of the front of an embodiment of an arc furnace.

In FIG. 1, the arc furnace shell 1 with the furnace lid 5 are supported in an opening on the platform 6. The latter is supported on two swivelling cradles 7 which in turn are supported on the movable beams 8, which are firmly fixed to the base 9. The pouring spout 2 can also be seen in FIG. 1. A movable rotating pedestal 10 is arranged on the platform 6 and the lid lifting and swivelling means 11 is attached to it. The lid lifting and swivelling means 11 consists of a support arm 13 and a support arm column 12.

Platform 6 also supports three electrode adjustment columns 14, only one of which is visible in FIG. 1. The electrode adjustment columns 14 are hydraulically connected, individually and in a movable fashion, in the vertical direction with electrode adjustment cylinders 15. The electrode supporting arms 16 are attached to the electrode adjustment columns 14; the electrodes 18 are held in electrode holders 17 at the outer ends of the electrode arms 16.

Again only one of the total of three electrode supporting arms 16 is completely visible in FIG. 1; only two of the electrodes 18 are visible, the third one being hidden. The flue gas exhaust nozzle 19 with flange 20 is arranged on the furnace lid 5, the lid ring 4 of which lies on the lid supporting ring 3 of the furnace shell 1. The fixing arrangement of the nozzle 19 is not shown at all in FIG. 1 and its guiding arrangement within the support arm 13 of the lid lifting and swivelling means 11 is only roughly indicated by the guide rail 21; it is shown in detail in FIGS. 4, 5 and 6. Carrying loops 22 are fixed on the lid ring 4 of the furnace lid 5. In the embodiment of FIG. 1, carrying cables 23, of which only two out of a total of four are visible, are fixed to the carrying loops 22. The carrying cables 23 are guided over rollers 24, which are supported in roller carriers 25 on the support arm 13. The carrying cables 23 are connected with the hydraulic cylinder 26, which can raise or lower the furnace lid 5 of the furnace shell 1.

Figure 2:
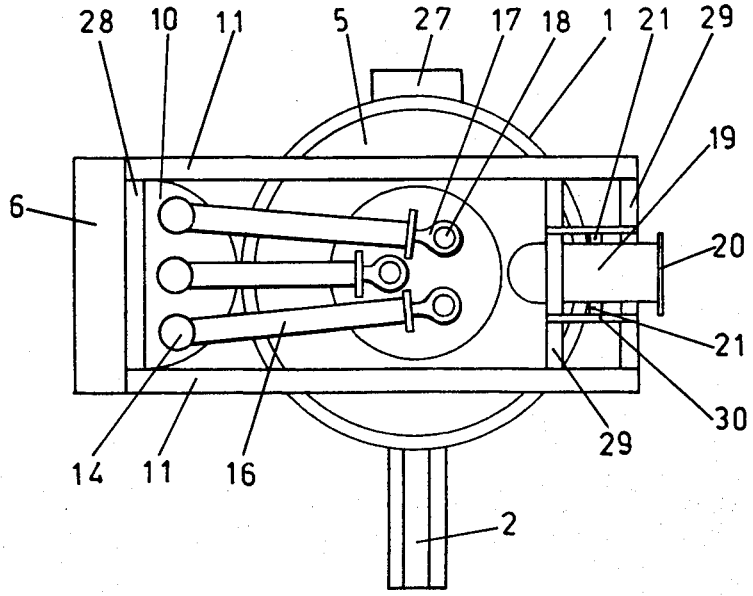
FIG. 2 is a schematic plan of the furnace according to FIG. 1.
Figure 3:
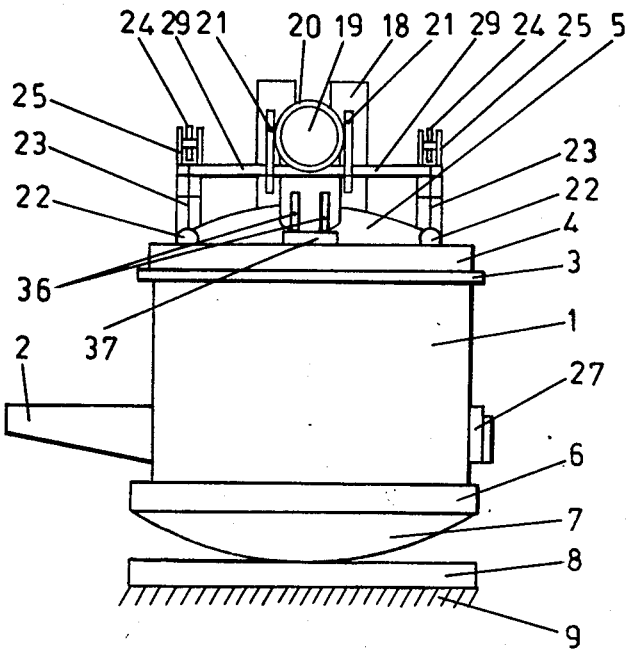
FIG. 3 is a schematic side view of the furnace according to FIG. 1.

The reference numbers on FIG. 1 apply to the same parts of FIG. 2 as well as to the other drawings.

The lid lifting structure with the I beams 29 and the connecting tie bar 28 can readily be recognised in FIG. 2.

Channel shaped beams 30 are fixed on the I beams 29 and extend perpendicular to them; the nozzle 19 is arranged between the channel shaped beams 30. Between the beams 30 and the nozzle is the guide rail 21. The slag door 27 is fitted on the furnace shell 1.

The electrode adjustment columns 14 are arranged on the rotating pedestal 10 in addition to the lid lifting and swivelling means 11. These electrode adjustment columns 14 have, as described in detail in FIG. 1, electrode supporting arms 16; at their upper ends the electrodes 18 are held in electrode holders 17. After the furnace lid 5 is raised from the furnace shell 1 by means of the lifting mechanism described in FIG. 1, the lid lifting means 11 together with the raised lid 5 are swivelled sideways away from the vicinity of the furnace shell 1 by means of the rotating pedestal 10, until the top of the furnace shell 1 is completely free and the arc furnace can be charged.

Electrode adjustment columns 14 are also situated on the rotating pedestal 10, as already mentioned, and these are therefore also swivelled away. In order to be able to carry out this swivelling process at all it is clear that the electrodes must first be raised up above the upper edge of the furnace shell 1.

The flue gas exhaust nozzle 19, situated within the symmetrically arranged guide rails 21, is supported on the lid ring 3 via the stay 36 and the base 37.

Figure 4:
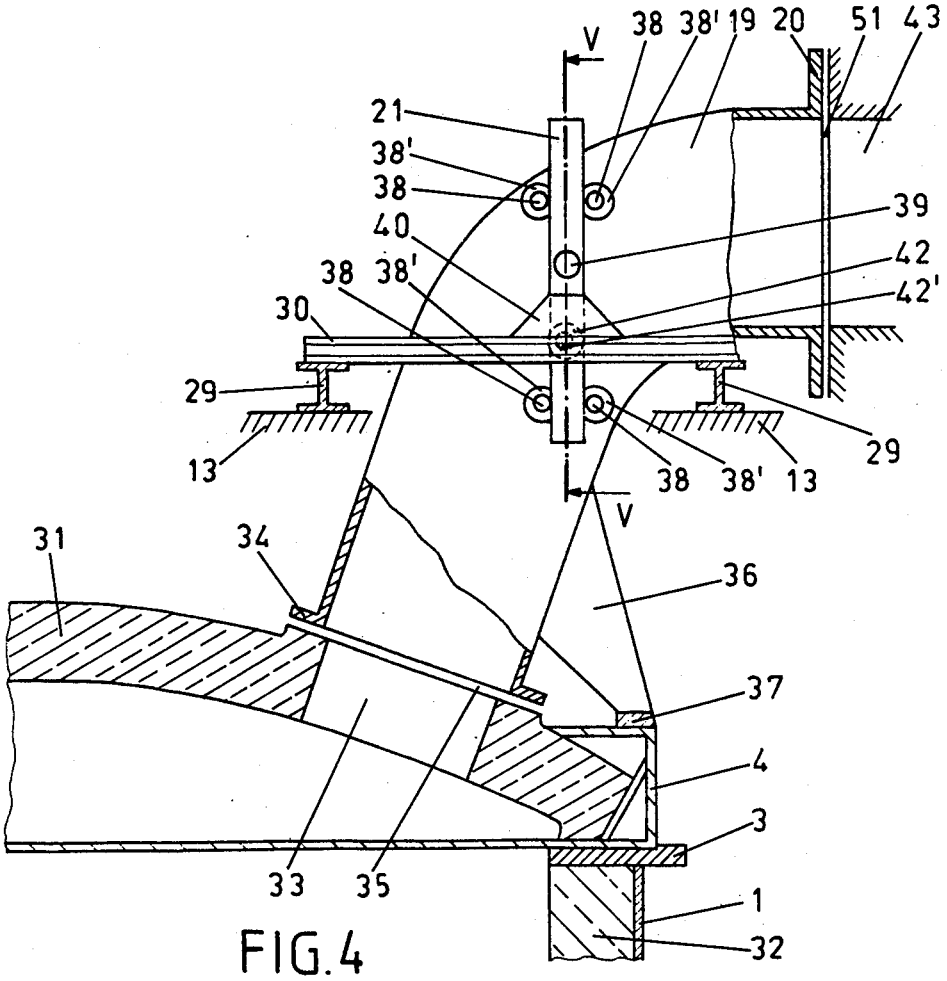
FIG. 4 is an enlarged, vertical, partial section through the front view of a flue gas exhaust nozzle, which includes a first variant of an embodiment of a guide arrangement and a locking means for the nozzle.

In the variant of FIG. 4, the nozzle 19 with its flange 34 is positioned exactly above the lid opening 33, with a gap 35 between the lid lining 31 and the flange 34 of the nozzle 19. On its other end, the nozzle 19 is exactly in alignment with the flue gas exhaust flue 43, which is fixed in place. The gap 51 is provided between the flue gas exhaust flue 43 and the flange 20 of the nozzle 19. The two gap openings 35 and 51 ensure that the nozzle 19 does not strike the lid lining 31 and the flue gas exhaust flue 43 either in a static position or when lifted. The gaps 35 and 41 are dimensioned in such a way that while there is enough play for the lifting operations of the nozzle 19, the ingress of outside air is restricted to a minimum.

The whole weight of nozzle 19 is supported on the lid ring 4 via the stay 36 and the base 37 of the stay 36.

The lid ring 4 rests on the lid supporting ring 3, which is firmly attached to the furnace shell 1. Inside the furnace shell 1 there is the refractory lining 32.

By means of the guide arrangement, which consists of guide rail 21 and guide rollers 38, the nozzle 19 is guided during lifting of the nozzle 19 or the furnace lid and is supported during tilting of the furnace. In the embodiment of FIG. 4 the guide rail 21 is firmly fixed to the support arm 13 of the lid lifting and swivelling means 11 via the channel beams 30 and I beams 29. The support arm 13 is only schematically shown in FIG. 4. A reinforcing piece 40 is additionally attached to reinforce this connection. The guide rollers 38 are firmly attached to the nozzle 19 and the guide rail 21 is guided between two pairs of guide rollers 38.

Figure 5:
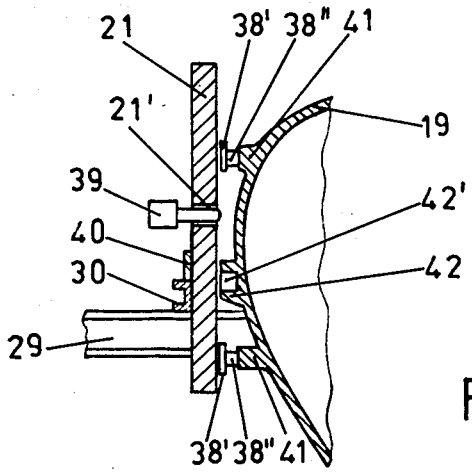
FIG. 5 is an enlarged, vertical, partial section V—V through the side view of a flue gas exhaust nozzle according to FIG. 4.

The guide rollers 38, which are not visible in FIG. 5, are firmly attached to the nozzle 19 via roller shafts 38'' in the protruding lugs 41 of the nozzle 19.

The supporting rim 38' of each roller shaft secures the guide rollers 38 and thus also the nozzle 19 against sideways displacement.

The locking device 39, 42', which secures the nozzle 19 in the raised position, can be seen in FIG. 5. It consists of a movable pin 39 which is arranged in the bore 21' of the guide rail 21 and registers with the bore 42' in the protruding lug 42 of the nozzle 19.

In the embodiment according to FIGS. 4 and 5 only one side of the nozzle 19 is guided and fitted for locking. It is obvious, however, that the guide arrangement 21, 38 and the locking device 39, 42' can be arranged symmetrically on both sides of the nozzle 19 and that the nozzle 19 is guided and lockable on both sides.

The mode of functioning of the guide arrangement 21, 38 and the locking device 39, 42' is described below:

During lid replacement if the furnace lid 5, which includes the lid ring 4 and the refractory lining 31, is to be lifted for replacement, the hydraulic cylinder 26 is operated, which exerts pulling forces on the carrying cables 23 and loops 22, the lid 5 thus being raised. Since the nozzle 19 is supported on the lid ring 4 of the lid 5, it is automatically raised as well as it is guided by means of the guide arrangement 21, 38 until the bore 42' of the protruding lug 42 of the nozzle 19 is at the same height as the bore 21' of the guide rail 21. Then the movable pin 39 can be introduced into the bore 42' and the nozzle 19 can be locked in position.

The lid 5 to be swivelled-over into position on the lid exchanger is now separated from the nozzle 19 by simple lowering of the lid 5 while the nozzle 19 remains guided and locked in the support arm 13 of the lid lifting and swivelling means 11. The lid 5 separated from the nozzle 19 can now be lowered completely onto the lid exchanger and can be replaced. The new lid 5 is lifted by means of the carrying cables 23 until the nozzle 19 is again completely supported on the lid ring 4 of the lid 5. Then the movable pin 39 is removed from the bore 42' of the protruding lug 42 in the nozzle, the lid 5 together with nozzle 19 is swivelled back into the starting position and lid 5 and nozzle 19 are together brought to rest on the lid support ring 3 of the furnace shell 1, so that the smelting process can begin again.

In the normal charging process, lid 5 together with nozzle 19 are swivelled out of the vicinity of the furnace vessel, then after charging is completed, are brought again into the starting position and are lowered onto the furnace shell 1. During a normal charging process a locking of the nozzle 19 is not necessary.

Figure 6:
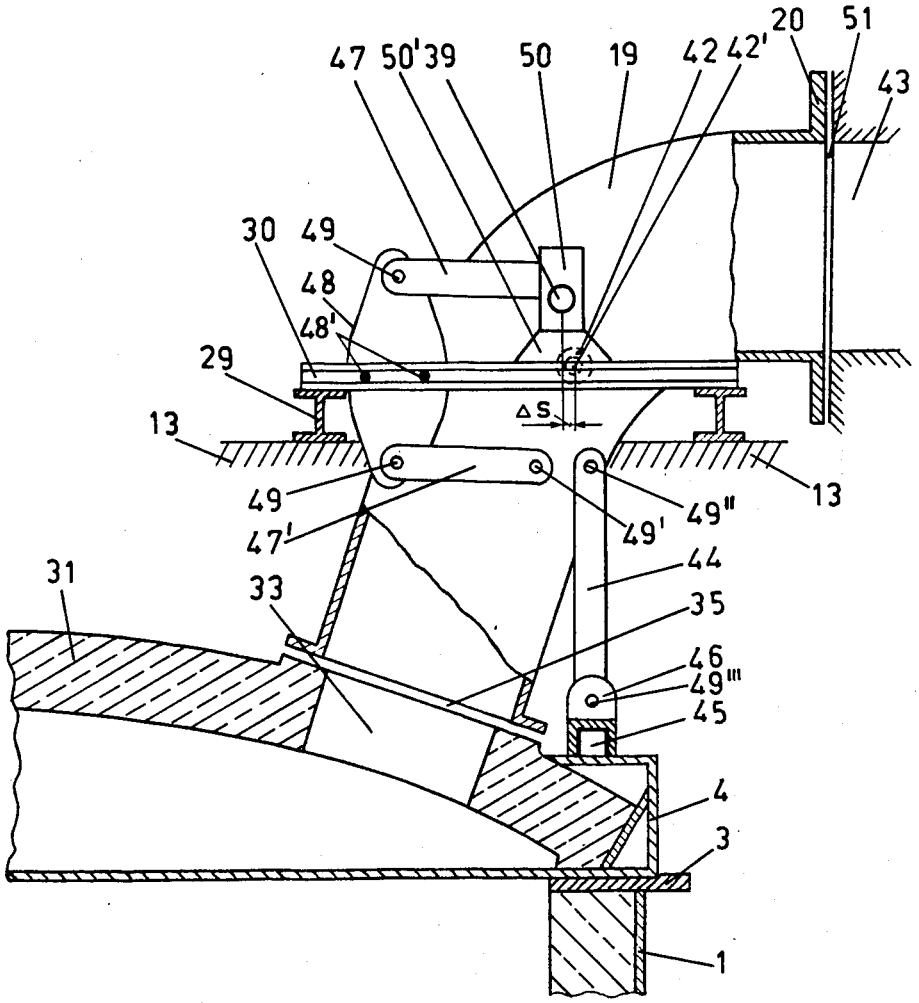
FIG. 6 is an enlarged, vertical, partial section through the front view of a flue gas nozzle, which includes a second variant of a guide arrangement and a locking means.

In the variant of FIG. 6, whole weight of the nozzle 19 is completely supported on the lid ring 4 via a further lever 44 and a channel beam 45, which serves as a base for the lever 44.

The lever 44 is firmly attached to the channel beam by means of the connecting piece 46; lever 44 and connecting piece 46 are, in turn, pivotally connected with each other through connecting pins 49''. The lever 44 is pivotally connected to the nozzle by the connecting pins 49''.

In this variant the guide means of the nozzle 19 consists of two guide levers 47, 47', which are connected, at their ends to the support arm 13 of the lid lifting and swivelling means 11 via connecting bracket 48, channel shaped beam 30 and I beam 29. The support arm 13 is only shown schematically in FIG. 6. The connection of the ends of the guide levers 47, 47' with the connecting strap 48 is pivotal, since it is performed via movably supported pins 49. The other ends of the guide levers 47, 47' are in turn connected with the nozzle 19 through movably supported pins 49'. In FIG. 6 the connection of the guide lever 47 with the nozzle 19 is hidden by the fixing bracket 50 and thus is not visible.

The locking device 39, 42' consists of a movable pin 39, which is arranged in a bore in the fixing bracket 50 (not visible in FIG. 6).

The fixing bracket 50 is firmly attached to the channel beam 30, the I beam 29 and the support arm 13 of the lid lifting and swivelling means 11 at its widened lower part 50'.

If the lid 5 is lifted by means of the movement mechanism 22, 23, 26 described in detail in FIG. 4, the forces are transmitted to the nozzle 19 via the channel beam 45, the connecting piece 46 and the lever 44; the nozzle 19 is lifted at the same time, is moved relative to the support arm 13 of the lid lifting and swivelling means 11 and is guided by means of the guide levers 47, 47'. Since the guide levers 47, 47' are arranged to be acting in the same direction and are equally long, the nozzle 19, on lifting, is guided at right angles to the support arm 13 and is swivelled to the left in the arc of a circle with the radius equal to the length of the guide levers 47 and 47' from pin support 49 to pin support 49'. The lever 44 is therefore also pivotally supported, at the nozzle by means of the pin 49'' as well as at the connecting piece 46 by means of the pin 49''', in order that the lever 44 can follow the slight movement of the nozzle 19 leftwards when the nozzle 19 is lifted.

When the lid 5 and the nozzle 19 are lifted, the bore 42' in the protruding lug 42 of the nozzle 19 is moved in a vertical direction and also in a horizontal direction and also in a horizontal direction by the amount $\Delta S$ to the left. When the bore in the connecting bracket 50', with the movable pin 39 in it, is in alignment with the bore 42', the pin 39 can be introduced into the bore 42'.

The nozzle 19 remains guided and locked in the support arm 13 of the lid lifting and swivelling means 11, after the lid 5 has again been lowered and thus separated from the nozzle 19.

The same functional items which were described in detail in FIG. 4 apply to the further operating steps, such as lid replacement and charging of the furnace.

Obviously, numerous modifications and variations of the present invention are possible in light of the above teachings. It is therefore to be understood that within the scope of the appended claims, the invention may be practiced otherwise than as specifically described herein.

What is claimed as new and is intended to be secured by Letters Patent is:

1. An arc furnace comprising:

a furnace shell having a top opening;

a removable lid covering said top opening, said lid including a lid ring and a lid opening;

a flue gas exhaust nozzle having one end positioned adjacent said lid opening for exhausting flue gases from said furnace;

means for lifting and swivelling said lid; and means for supporting said nozzle on said lid ring;

wherein said nozzle includes guide means for guiding said nozzle when said lid is lifted and swivelled by said lid lifting and swivelling means, comprising a stationary element, at least one pair of rollers connected to one of said nozzle and said stationary element, and at least one guide rail extending in the direction of movement of said lid, said guide rail cooperating with said rollers and being fixed to the other of said nozzle and said stationary element.

2. The furnace of claim 1 wherein each said at least one guide rail is guided between two of said guide rollers.

3. The furnace of claim 1 wherein said stationary element is a support arm of said lid lifting and swivelling means and wherein said guide rollers are connected to said nozzle.

4. The furnace of claim 1 wherein said stationary element is a support arm of said lifting and swivelling means, wherein said at least one guide rail is connected to said nozzle, and wherein said guide rollers are connected to said support arm.

5. An arc furnace comprising:

a furnace shell having a top opening;

a removable lid covering said top opening, said lid including a lid ring and a lid opening;

a flue gas exhaust nozzle having one end positioned adjacent said lid opening for exhausting flue gases from said furnace;

means for lifting and swivelling said lid; and means for supporting said nozzle on said lid ring;

wherein said nozzle includes guides means for guiding said nozzle when said lid is lifted and swivelled by said lid lifting and swivelling means, and said guide means include locking means for securing said nozzle in a raised position.

* * * * *